United States Patent [19]

La Rossa

[11] 4,168,980

[45] Sep. 25, 1979

[54] HEAT DEVELOPABLE PHOTOGRAPHIC MATERIAL AND PROCESS

[75] Inventor: Robert A. La Rossa, Webster, N.Y.

[73] Assignee: Eastman Kodak Company, Rochester, N.Y.

[21] Appl. No.: 825,899

[22] Filed: Aug. 19, 1977

[51] Int. Cl.[2] ..... G03C 1/72; G03C 1/34; G03C 3/00; G03C 5/24

[52] U.S. Cl. ..... 96/114.1; 96/109; 96/67; 96/48 HD

[58] Field of Search ..... 96/114.1, 114.6, 109, 96/67, 48 HD

[56] References Cited

U.S. PATENT DOCUMENTS

| | | | |
|---|---|---|---|
| 3,252,799 | 5/1966 | Götze et al. | 96/109 |
| 3,457,075 | 6/1969 | Morgan et al. | 96/114.1 |
| 3,617,289 | 11/1971 | Ohkubo et al. | 96/114.1 |
| 3,647,439 | 3/1972 | Bass | 96/114.6 |
| 3,767,414 | 10/1973 | Huffman et al. | 96/114.6 |
| 3,785,830 | 1/1974 | Sullivan et al. | 96/114.1 |
| 3,801,330 | 4/1974 | Brinckman et al. | 96/114.1 |
| 3,839,041 | 10/1974 | Hiller | 96/114.1 |
| 4,009,039 | 2/1977 | Masuda et al. | 96/109 |

FOREIGN PATENT DOCUMENTS

| | | | |
|---|---|---|---|
| 765452 | 4/1975 | Belgium | 96/114.1 |
| 2019576 | 6/1970 | France | 96/67 |

OTHER PUBLICATIONS

Research Disclosure, Oct. 1976, Item 15027, p. 22.

Stabilization of Photographic Silver Halide Emulsions-Birr, pp. 192–201, ©1974, Focal Press, N.Y.

*Primary Examiner*—Travis Brown

*Assistant Examiner*—L. Falasco

*Attorney, Agent, or Firm*—Richard E. Knapp

[57] ABSTRACT

A heat developable photographic material comprising, in reactive association, (a) photosensitive silver halide, with (b) an image-forming combination comprising (i) a silver imidazoline-2-thione wherein the imidazoline-2-thione portion is a 1-methyl, 1-ethyl or 1-phenyl-4-imidazoline-2-thione, with (ii) an organic, silver halide developing agent and (c) a binder, can provide developed and stabilized images without the need for processing solutions or baths. An image can be developed and stabilized in this material by merely heating the material to moderately elevated temperatures after imagewise exposure. Other addenda employed in heat developable photographic silver halide materials can be employed with the heat developable photographic materials described.

47 Claims, No Drawings

HEAT DEVELOPABLE PHOTOGRAPHIC MATERIAL AND PROCESS

BACKGROUND OF THE INVENTION

1. Field of the Invention

This invention relates to heat developable photographic silver halide materials and process for developing and stabilizing an image with these materials. In one of its aspects it relates to a heat developable photographic element comprising a support having thereon a certain combination of materials including an image-forming combination comprising (i) a certain silver imidazoline-2-thione, with (ii) an organic, silver halide developing agent and a binder. In another aspect it relates to a heat developable photographic composition comprising the described imaging combination. A further aspect of the invention relates to a process of developing and stabilizing an image in a heat developable photographic element containing the described imaging combination.

2. Description of the State of the Art

It is known to obtain an image in a photographic material by what is described as dry processing with heat. Such photographic materials are sometimes described as heat developable photographic materials or photothermographic materials. Such heat developable photographic materials or photothermographic materials, after imagewise exposure, are heated to provide a developed image in the absence of separate processing solutions or baths. In some cases, the developed image is also stabilized, such as with an incorporated stabilizer or stabilizer precursor in the photographic material. Typical heat developable imaging materials or photothermographic materials are described, for example, in U.S. Pat. No. 3,152,904 of Sorensen et al, issued Oct. 13, 1964; U.S. Pat. No. 3,457,075 of Morgan et al, issued July 22, 1969; U.S. Pat. No. 3,152,903 of Shepard et al, issued Oct. 13, 1964; U.S. Pat. No. 3,392,020 of Yutzy et al, issued July 9, 1968; British Specification No. 1,161,777 published Aug. 20, 1969; and U.S. Pat. No. 3,801,321 of Evans et al, issued Apr. 2, 1974.

The most commonly employed silver salts in such heat developable photographic materials are silver salts of long-chain fatty acids such as silver behenate and silver stearate. It has been desirable to replace these silver salts of long-chain fatty acids to enable use of aqueous or hydrophilic compositions which further enable the use of conventional silver halide technology, especially silver halide gelatino emulsion technology in heat developable photographic materials. Use of silver behenate as a source of silver in the described heat developable materials is not particularly compatible with aqueous formulations of silver halide photographic materials. Other silver salts or complexes have been proposed for the described heat developable photographic materials. These include, for example, silver salts of benzotriazole, silver salts of saccharin and related silver salts or complexes. These other silver salts are described, for example, in heat developable photographic materials in U.S. Pat. No. 3,617,289 of Ohkubo et al, issued Oct. 2, 1971; U.S. Pat. No. 3,666,477 of Goffe, issued May 30, 1972; U.S. Pat. No. 3,672,904 of deMauriac, issued June 27, 1972; U.S. Pat. No. 3,832,186 of Masuda et al, issued Aug. 27, 1974; British Specification No. 1,205,500 published Sept. 16, 1970; U.S. Pat. No. 3,689,270 of Anderson et al, issued Sept. 5, 1972; U.S. Pat. No. 3,785,830 of Sullivan et al, issued Jan. 15, 1974; and copending U.S. application Ser. No. 684,699 of deMauriac, filed May 10, 1976, now abandoned. While many of these silver complexes or salts can provide an image in a heat developable photographic silver halide material, they often provide undesirable processing temperature latitude, undesired photographic speed, undesired image tone, do not provide a stable image after processing, or a combination of one or more of these problems.

It has also been desirable to provide heat developable and stabilizable photographic materials which enable use of commonly employed silver halide developing agents in the photographic material. Heat developable photographic materials often have used reducing agents not commonly employed in silver halide photography which require costly processes of preparation. It has been desirable to eliminate this problem with a heat developable and stabilizable photographic material which better enables use of conventional developing agents, such as phenolic developing agents and ascorbic acid developing agents, which do not adversely affect the post-processing stabilization of the material. Typical reducing agents which have been used in heat developable photographic materials are described, for example, in U.S. Pat. No. 3,672,904 of deMauriac, issued June 27, 1972 and other of the described patents. Commercially available photothermographic materials have used such reducing agents as 2,2'-methylenebis(4-methyl-6-tertiarybutylphenol) which is not a conventional silver halide developing agent.

Photographic materials which are not heat developable photographic materials are known containing nitrogen acids. Nitrogen acids, for example, are described in photographic materials in Belgian Pat. No. 790,955 issued May 3, 1973 and U.S. Pat. No. 3,933,507 of Von Konig et al, issued Jan. 20, 1976. Silver salts of certain nitrogen acids have also been found useful in photographic materials which are heat processable as described in copending U.S. application Ser. No. 684,699 of deMauriac, filed May 10, 1976, now abandoned. None of these references, however, indicate or suggest answers to the described problems in heat developable photographic materials which are required to be stable after processing without a subsequent processing step or separate incorporated stabilizer or stabilizer precursor.

Silver salts of a variety of organic compounds are known for various purposes in photographic materials. For example, some of the silver salts of organic compounds can be useful as incorporated couplers such as described in U.S. Pat. No. 2,353,754 of Peterson, issued July 18, 1944 and U.S. Pat. No. 3,794,496 of Manhart, issued Feb. 26, 1974. Silver salts of certain heterocyclic thione compounds have also been found useful in heat developable materials such as described in U.S. Pat. No. 3,785,830 of Sullivan et al, issued Jan. 15, 1974. These references, however, do not describe a heat developable and stabilizable photographic material containing a silver 1-methyl, 1-ethyl or 1-phenyl-4-imidazoline-2-thione in an image-forming combination as described herein.

Imidazoline-2-thione compounds have been used in heat developable photographic materials for post-processing stabilization purposes. These materials are described, for example, in U.S. Pat. No. 3,839,041 of Hiller, issued Oct. 1, 1974 and U.S. Pat. No. 3,801,330 of Brinckman et al, issued Apr. 2, 1974. Neither of these patents indicate that the described imidazoline-2-thione compounds can provide a silver salt or complex as described herein which provides both a source of silver in an image-forming combination and provides post-processing stabilization without the need for a separate image stabilizer or stabilizer precursor.

There has been a continuing need for improved heat developable photographic materials containing image-forming combinations comprising a silver salt imidazoline-2-thione with an organic silver halide developing agent. As illustrated in the comparative examples in the following description, selection of a suitable silver imidazoline-2-thione can in many cases provide a heat developable material which does not have the desired post-processing stability or lacks other desired properties in combination with a desired developed image. This need has been particularly important for heat developable photographic materials which have the desired degree of photosensitivity provided by photographic silver halide and which enable the use of conventional gelatino silver halide emulsion technology.

SUMMARY OF THE INVENTION

It has been found according to the invention that the described advantages can be provided by a heat developable photographic material comprising, in reactive association, (a) photosensitive silver halide, especially a photographic silver halide gelatino emulsion, with (b) an image-forming combination comprising (i) a silver imidazoline-2-thione, with (ii) an organic, silver halide developing agent and (c) a binder, wherein the imidazoline-2-thione portion of the silver imidazoline-2-thione is a 1-methyl, 1-ethyl or 1-phenyl-4-imidazoline-2-thione ligand; wherein the ratio of said ligand to silver ion in the silver imidazoline-2-thione is at least 1.0 and, wherein the combination of (a), (b) and (c) form a reaction melt at a temperature within the range of about 120° C. to 200° C. An especially useful heat developable photographic material, as described, is one wherein the ratio of the described ligand to silver ion in the silver salt is within the range of about 1.2 to about 1.5. According to the invention, after imagewise exposure of the described material an image can be developed and stabilized in the material by heating the material to a temperature within the range of about 120° C. to about 200° C. until an image is developed and stabilized. This eliminates the need for any separate processing solutions or baths and also eliminates the need for a separate post-processing image stabilizer or stabilizer precursor incorporated in the material.

It has also been found, according to the invention, that other silver salts of heterocyclic compounds can be useful in combination with the described silver 4-imidazoline-2-thione. Accordingly, an embodiment of the invention is a heat developable photographic material comprising, in reactive association, (a) photosensitive silver halide, especially a photographic silver halide gelatino emulsion, (b) an image-forming combination comprising (i) a silver 4-imidazoline-2-thione, as described, with (ii) a silver 1,2,4-mercaptotriazole wherein the 1,2,4-mercaptotriazole portion is represented by the formula:

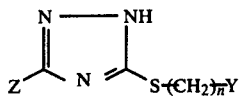

wherein Y is aryl containing 6 to 12 carbon atoms, such as phenyl, p-methoxyphenyl or p-chlorophenyl; n is 0 to 2; and Z is hydrogen, hydroxyl or —$NH_2$; and (iii) an organic, silver halide developing agent, and (c) a binder. This material can provide a developed and stabilized image after imagewise exposure by merely heating the material.

DETAILED DESCRIPTION OF THE INVENTION

An important embodiment of the invention is a heat developable photographic element comprising a support having thereon in reactive association components (a), (b) and (c) as described. Several silver imidazoline-2-thione materials provide a source of silver for development in a heat developable photographic material containing photosensitive silver halide and an organic silver halide developing agent; but, several of these silver materials do not provide the desired properties, such as the desired degree of post-processing stabilization. This is illustrated in the following comparative examples in Table I. The imidazoline-2-thione ligands which have been found especially useful according to the invention are the 1-methyl, 1-ethyl and 1-phenyl-4-imidazoline-2-thione ligands. The described methyl, ethyl and phenyl groups can have substituents that do not adversely affect the sensitometric or other desired properties of the photographic material of the invention. For example, the 1-ethyl group, as described, can be 1-hydroxyethyl to provide silver 1-hydroxyethyl-4-imidazoline-2-thione. The mechanism by which the described silver imidazoline-2-thione, also referred to herein as organic silver salts, provide silver for development and provide post-processing stabilization is not fully understood. It is not completely clear why some silver imidazoline-2-thione materials provide development while others provide both development and stabilization as desired.

If desired, combinations of silver imidazoline-2-thione materials, as described, can be useful. For instance, a combination of a silver 1-methyl and 1-ethyl-4-imidazoline-2-thione can be useful in a photographic material as described.

The 1-methyl, 1-ethyl and 1-phenyl-4-imidazoline-2-thione compounds, also described herein as ligands, from which the desired organic silver salts are prepared are known compounds and can be prepared using processes known in the art. The desired organic silver salts can be prepared separately from other components of the described heat developable photographic material. The described imidazoline-2-thione ligands can also be prepared by methods known in the art such as described in Chemical Abstracts, Volume 52, page 1999.

The term "organic silver salt" and the term "organic silver complex" as used herein are intended to include any type of bonding or complexing mechanism which enables the resulting material to provide imaging properties in the described image-forming combination. In some instances the exact bonding of the described salt or complex of silver with the described imidazoline-2-thione ligand, also referred to herein as organic silver salts, is not fully understood. Accordingly, the term "organic silver complex" and the term "organic silver salt" are intended to include salts and other forms of bonding which enable the desired image-forming combination to provide the desired image as described. The term "complex" is intended to include neutral complexes and non-neutral complexes.

An advantage of the described heat developable photographic material and process of the invention is that hydrophilic or aqueous formulations, such as aqueous gelatino emulsions, are useful with the described components of the material. The heat developable photographic material as described comprise a photosensitive silver halide or combination of photosensitive silver halides. The photosensitive silver halide is especially useful due to its increased photosensitivity compared to other photographic components. A typical concentration of photosensitive silver halide in a heat developable photographic material according to the invention is within the range of about 0.01 to about 0.5 moles of photosensitive silver halide per mole of organic silver salt in the heat developable and heat stabilizable photographic material. For example, a typical concentration range of photosensitive silver halide is within the range of about 0.05 to about 0.1 mole of photosensitive silver halide per mole of organic silver salt in the described material. Other photographic materials can be useful in combination with the described photosensitive silver halide if desired. Especially useful photographic silver halides are silver chloride, silver bromoiodide, silver chlorobromoiodide or mixtures thereof. For purposes of the invention, silver iodide is also considered to be a useful photosensitive silver halide. Very fine-grain photosensitive silver halide is useful, although coarse- or fine-grain photosensitive silver halide can be employed if desired. The photosensitive silver halide can be prepared by any of the procedures known in the photographic art, especially those procedures which involve the preparation of photographic silver halide gelatino emulsions. Useful procedures and forms of photographic silver halide for purposes of the invention are described, for example, in the *Product Licensing Index,* Volume 92, December 1971, Publication 9232, published by Industrial Opportunities Ltd., Homewell, Havant, Hampshire PO9, 1EF, UK. The photosensitive silver halide as described can be unwashed or washed, can be chemically sensitized using chemical sensitization procedures and components known in the art, can be protected against production of fog and stabilized against loss of sensitivity during keeping as described in the above *Product Licensing Index* publication.

The described silver halide developing agent can comprise a variety of organic, photographic silver halide developing agents. Combinations of silver halide developing agents can be useful. Silver halide developing agents which are especially useful include polyhydroxybenzenes, such as hydroquinone, alkyl-substituted hydroquinones, including tertiary butylhydroquinone, methylhydroquinone, 2,5-dimethylhydroquinone, and 2,6-dimethylhydroquinone; catechol and pyrogallol developing agents; chloro-substituted hydroquinones such as dichlorohydroquinone or chlorohydroquinone; carboxy alkyl hydroquinones, such as 2,5-dihydroxyphenyl acetic acid and 2,5-dihydroxyphenyl butyric acid; alkoxy-substituted hydroquinones such as methoxyhydroquinone or ethoxyhydroquinone; aminophenol developing agents such as 2,4-diaminophenols and methylaminophenols; ascorbic acid developing agents such as ascorbic acid, ascorbic acid ketals and ascorbic acid derivatives; hydroxylamine reducing agents; 3-pyrazolidone developing agents such as 1-phenyl-3-pyrazolidone and 4-methyl-4-hydroxymethyl-1-phenyl-3-pyrazolidone; reductone reducing agents, such as anhydro dihydro piperidino hexose reductone and the like. Hydroquinones are most useful in combination with 3-pyrazolidone developing agents. Phenylenediamine silver halide developing agents, such as paraphenylenediamine can also be useful. Especially useful heat developable photographic materials, as described, contain as the silver halide developing agent a compound selected from the group consisting of hydroquinone, ascorbic acid, pyrogallol, gallic acid esters, and phenylenediamine silver halide developing agents and combinations thereof. Pyrazolidone developing agents are preferred.

A useful concentration of silver halide developing agent or combination of developing agents in a photographic material, as described, is typically within the range of about 0.1 mole to about 3 moles of developing agent or developing agent combination per mole of organic silver salt, as described. An especially useful concentration of silver halide developing agent or developing agent combination is within the range of about 0.5 to about 1.5 moles of developing agent per mole of organic silver salt. The optimum concentration of developing agent will vary depending upon a variety of factors, such as the desired image, other components in the heat developable photographic material, the particular silver salt of the imidazoline-2-thione ligand, processing conditions and the like.

The heat developable photographic material, according to the invention, can comprise a variety of colloids and polymers as the described binder. The described colloids and polymers can be useful alone or in combination. Suitable colloids and polymers, as described, are preferably hydrophilic materials, although some hydrophobic materials can be useful. The colloids and polymers are transparent or translucent and include both naturally-occurring substances such as proteins, for example, gelatin, gelatin derivatives, cellulose derivatives, polysaccharides, such as dextran, and the like; and synthetic materials such as water soluble polyvinyl compounds, acrylamide polymers and the like. Other synthetic polymeric compounds which can be useful include dispersed vinyl compounds such as in latex form and particularly those which increase dimensional stability of the photographic materials. Effective polymers include high molecular weight materials, polymers and resins which are compatible with the described complex of silver and other components of the heat developable photographic material according to the invention. Especially useful binder materials include gelatin and poly(vinyl alcohol). Other useful polymeric materials include a copolymer of acrylamide and 1-vinylimidazole and a copolymer of acrylamide and 2-acetoacetoxyethylmethacrylate. Combinations of the described colloids and polymers can be especially useful. Certain of the heat developable photographic materials can be prepared without a polymeric binder.

The heat developable photographic materials according to the invention can, if desired, contain an image toner to help provide a more neutral (black) tone image upon processing. Combinations of toning agents can be useful if desired. Care should be taken to select a toning agent that does not adversely affect image formation and desired stabilization. 3-Mercapto-1,2,4-triazole can be a useful toning agent. The optimum toning agent or toning agent combination will depend upon such factors as the particular heat developable photographic material, the desired image, particular processing conditions and the like. In some cases certain image toning agents provide much better results with certain complexes of silver as described than other organic silver salts. A simple screening test can be useful to select an optimum image-toning agent. One such test comprises that described in following Example 2. The toning agent to be tested can be added to the photographic material described in this example. The organic silver salt as described in that example can be replaced with other organic silver salts within the scope of the described photographic material according to the invention to select the optimum image-toning agent for the particular complex. In this test the most useful toning agent is typically that toning agent which provides a ratio of (a) visible maximum density to (b) blue light maximum density exceeding a value of 0.87. The toning agents can be useful in combination, if desired.

A range of concentration of toning agent or toning agent combination is useful in a heat developable photographic material according to the invention. A typically useful concentration of toning agent or toning agent combination is within the range of about 0.01 to about 0.1 mole of toning agent per mole of the organic silver salt as described. The optimum concentration of toning agent will depend upon such factors as the particular heat developable photographic material, processing conditions, desired image and the like.

It is necessary in order to provide a desired image that the photosensitive silver halide, the image-forming combination and binder as described form a reaction melt at a temperature which is useful for processing, that is a temperature within the range of about 120° C. to about 200° C. in order to have desired image formation. It is often useful to include a melt-forming compound in the described heat developable photographic material according to the invention to aid in providing the described reaction melt. The term "melt-forming compound" as employed herein is intended to mean a compound which upon heating to the described processing temperature provides an improved reaction medium, typically a molten medium, with the other described components of the imaging material that can provide better image development. The exact nature of the reaction medium or melt at processing temperature as described is not fully understood; however, it is believed that at the reaction temperature a molten reaction medium is provided which permits the reaction components to better interact. Useful melt-forming compounds are typically separate components from the image-forming combination, although the image-forming combination can and often does enter into the melt formation. Typically useful melt-forming compounds which can be added to the described imaging material are amides, imides, cyclic ureas and triazoles which are compatible with the other components of the heat developable photographic materials. Useful melt-forming compounds are described, for example, in *Research Disclosure,* October 1976, Vol. 150, Item 15027 of LaRossa and Boettcher, published by Industrial Opportunities Ltd., Homewell, Havant Hampshire, PO9 1EF, UK. Selection of an optimum melt-forming compound will depend upon such factors as the particular image-forming composition, processing temperature, desired image and the like. A variety of melt-forming compounds are useful including, for example, 1,3-dimethylurea, ascorbic acids, 1-phenyl-3-pyrazolidones and citric acid.

A range of concentration of melt-forming compound or combination of compounds is useful in the described heat developable photographic materials. A typically useful concentration range of melt-forming compound or combination of compounds is within the range of about 0.5 to about 2 parts by weight of melt-forming compound per gram of the described silver imidazoline-2-thione. The optimum concentration of melt-forming compound will depend upon such factors as the particular heat developable photographic material, the desired image, processing conditions, particular binder and the like.

Spectral sensitizing dyes can be useful in the described photographic materials of the invention to confer additional sensitivity to the elements and compositions. Useful sensitizing dyes are described, for example, in the *Product Licensing Index,* Volume 92, December 1971, Publication 9232, pages 107–110, paragraph XV, published by Industrial Opportunities Ltd., Homewell, Havant, Hampshire PO9 1EF, UK. An advantage of the heat developable photographic materials according to the invention is that a wider range of spectral sensitizing dyes is useful than with many other heat developable photographic materials. This is due in part to the use of hydrophilic or aqueous silver halide photographic materials, such as silver halide gelatino photographic emulsions, in the heat developable materials according to the invention.

The described silver imidazoline-2-thione can contain a range of molar ratio above 1.0 of the described imidazoline-2-thione portion of silver ion in the organic silver salt. The optimum ratio of the ligand to silver ion will depend upon such factors as the particular ligand, the particular heat developable material, desired post-processing stabilization, processing conditions and the like. However, the ratio of the ligand to silver as silver ion in the described silver imidazoline-2-thione is usefully within the range of about 1:1 to about 2:1. The ratio of ligand to silver as silver ion can be determined using methods known in the photographic art. Selection of an optimum ratio will depend upon such factors as the desired image, degree of stabilization, processing conditions and the like. An especially useful ratio of the described ligand to silver as silver ion is 1.4:1.

The heat developable photographic materials also can have a range of pAg. The pAg can be measured using conventional calomel and Ag-AgCl electrodes, connected to an Orion digital pH meter. The typical pAg in a heat developable photographic material according to the invention is within the range of about 2 to about 6, with the preferred range of pAg being about 3.5 to about 5.5. The optimum pAg will depend upon the described factors such as the particular heat developable material, the desired image, the particular ligand, processing conditions and the like.

The heat developable photographic materials described typically have a pH range which is on the acid side of neutral, that is a pH of less than about 6. A typically useful pH for a heat developable photographic material as described is within the range of about 1.5 to about 6, such as about 1.8 to about 3.5.

While it is often not necessary, a heat sensitive development activator, also known as an alkali-release agent, base-release agent or an activator precursor can be useful in the described imaging materials according to the invention. A useful heat sensitive base-release agent, as described herein, is intended to mean an agent or compound which aids the imaging process at processing temperatures with the described photosensitive silver halide and image-forming combination to develop a latent image. Combinations of heat sensitive development activators can be useful. Useful heat sensitive base-release agents or development activators are described, for example, in Belgian Pat. No. 709,967 published Feb. 29, 1968. Examples of useful heat sensitive base-release agents or development activators include guanidinium compounds such as guanidinium trichloroacetate and the like.

It is not necessary to use a separate stabilizer or separate stabilizer precursor in the described heat developable materials according to the invention for most purposes. If desired, however, a separate stabilizer or stabilizer precursor can be added to the heat developable photographic material as described. The stabilizers or stabilizer precursors can be used alone or in combination in such instances. Typical stabilizers or stabilizer precursors are thio or thione compounds which can provide a stable silver mercaptide upon processing of the described imaging materials.

It is in many cases useful to have an overcoat layer on the heat developable photographic element according to the invention to reduce fingerprinting and abrasion marks and provide other advantages. The overcoat layer can be one or more of the described polymers which are useful as binders or other polymeric materials found useful for coating purposes. The polymeric materials are those which are compatible with the heat developable and stabilizable layer and which can tolerate the processing temperatures employed according to the invention without adversely affecting the desired image formation. Typical binders and polymeric materials include, for example, cellulose acetate and poly(vinyl chloride). Combinations of polymeric materials can be useful for overcoat purposes if desired.

The heat developable materials according to the invention can contain other addenda which do not adversely affect the image formation, such as development modifiers that function as speed-increasing compounds, hardeners, plasticizers and lubricants, coating aids, brighteners, absorbing and filter dyes, antistatic materials or layers, and the like. These other addenda are described, for example, in the *Product Licensing Index,* Volume 92, December 1971, Publication 9232, published by Industrial Opportunities Ltd., Homewell, Havant, Hampshire, PO9 1EF, UK.

The heat developable elements according to the invention can comprise a variety of supports which can tolerate the processing temperatures employed according to the invention. Typical supports include cellulose ester film, poly(vinyl acetal) film, poly(ethylene terephthalate) film, polycarbonate film and polyester film supports as described, for example, in U.S. Pat. No. 3,634,089 of Hamb, issued July 11, 1972 and U.S. Pat. No. 3,725,070 of Hamb et al, issued Apr. 3, 1973. Related film and resinous support materials as well as glass, paper, metal and the like supports which can withstand the processing temperatures described can also be useful. Typically, a flexible support is most useful.

The imaging materials according to the invention can be coated on a suitable support by a variety of coating procedures known in the photographic art including dip coating, airknife coating, curtain coating or extrusion coating using hoppers such as described in U.S. Pat. No. 2,681,294 of Beguin, issued June 15, 1954. If desired, two or more layers can be coated simultaneously such as described in U.S. Pat. No. 2,761,791 of Russell, issued Sept. 4, 1956 and British Pat. No. 837,095 published June 9, 1960.

The described components of the heat developable materials according to the invention can be in any suitable location in the heat developable element which provides the desired image. For example, if desired, one or more components of the heat developable element according to the invention can be in one or more layers of the element. In some cases it can be desirable to include certain percentages of the described developing agents, or photosensitive silver halide or other addenda in a layer separate from the other components. It is necessary, however, that the photosensitive silver halide be in a location which is sufficiently contiguous to the described image-forming combination to enable the desired image-forming reaction to occur at the described processing temperature. In this sense it is necessary that the photosensitive silver halide, as described, and other components of the image-forming combination, be in reactive association with each other. The term "in reactive association" as employed herein is intended to mean that the photosensitive silver halide and the image-forming combination are in a location with respect to each other which enables the desired processing and provides a more useful developed image. It is believed that the latent image formed upon imagewise exposure of the photosensitive silver halide acts as a catalyst for the described image-forming combination at the described processing temperature. It is believed that this enables a lower processing temperature for image formation. While the exact nature of the reaction mechanisms of image formation as well as stabilization in the imaging material according to the invention is not fully understood, it is believed that the reaction is a type of amplification reaction enabled by the catalytic effect of the latent image silver. Accordingly, the term "in reactive association" is intended to mean that the components are in a location with respect to each other which enables this desired lower processing temperature, and enables a more useful developed image.

An especially useful embodiment of the invention is a heat developable photographic element comprising a support having thereon, in reactive association, (a) a gelatino photosensitive silver halide emulsion, (b) an image-forming combination comprising (i) a silver 1-methyl-4-imidazoline-2-thione, and (ii) an organic, silver halide developing agent, and (c) a polymeric binder, as described. An especially useful developing agent in this embodiment is a 3-pyrazolidone silver halide developing agent. The binder is usefully a gelatino binder.

For example, such an especially useful embodiment of the invention can comprise a heat developable photographic element comprising a support having thereon, in reactive association, (a) a gelatino photosensitive silver halide emulsion, (b) an image-forming combination comprising (i) a silver 1-methyl-4-imidazoline-2-thione having a molar ratio of the imidazoline-2-thione portion to silver ion in the silver 1-methyl-4-imidazoline-2-thione within the range of about 1.2 to about 1.5, with (ii) a combination of silver halide developing agents comprising 4-hydroxymethyl-4-methyl-1-phenyl-3-pyrazolidone with tertiary-butylhydroquinone or isopropyl hydroquinone, and (c) a gelatino binder, and wherein components (a), (b) and (c) form a reaction melt at a temperature within the range of about 120° C. to about 200° C.

It is often useful to incorporate an antifoggant in the described imaging material, such as a 3-mercapto-1,2,4-triazole antifoggant. An optimum concentration of such an antifoggant in the described imaging material will depend upon such factors as the particular imaging material, the particular ligand, processing conditions and the like. Typically, the antifoggant concentration is within the range of about 0.05 to about 0.1 mole of the antifoggant per mole of total silver in the imaging material.

Another example of a useful embodiment according to the invention is a heat developable photographic element comprising a support having thereon, in reactive association, (a) a gelatino photosensitive silver halide emulsion, typically a silver iodide emulsion, (b) an image-forming combination comprising (i) a silver imidazoline-2-thione wherein the imidazoline-2-thione is represented by the formula:

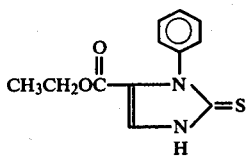

and the molar ratio of the imidazoline-2-thione portion to silver ion in the silver imidazoline-2-thione is within the range of about 1.2 to about 1.6, with (ii) an organic silver halide developing agent, typically a 3-pyrazolidone developing agent or an ascorbic acid developing agent, and (c) a gelatino binder, and wherein the components (a), (b) and (c) form a reaction melt at a temperature within the range of about 120° C. to about 200° C.

Another useful embodiment is one similar to that described wherein the imidazoline-2-thione ligand is a 1-hydroxyethyl-4-imidazoline-2-thione ligand and the silver salt has a ratio of ligand to silver ion within the range of about 1.2 to about 1.5. This can provide less than a desired image in some cases.

If desired, other heat developable photographic materials can be useful in combination with the heat developable photographic materials according to the invention. The other heat developable photographic materials must be compatible with and not adversely affect the image formation in a heat developable material according to the invention. An example of such a heat developable material is one containing a layer contiguous to the layer containing the silver imidazoline-2-thione and which separate layer contains photographic silver halide in reactive association with a silver salt of a compound which provides silver for physical development and an organic reducing agent. Another example is a heat developable photographic element comprising a support having thereon, in reactive association, (a) photosensitive silver halide, such as a photographic silver halide gelatino emulsion, (b) an image-forming combination comprising (i) a silver 4-imidazoline-2-thione, as described, with (ii) a silver 1,2,4-mercaptotriazole, such as one wherein the 1,2,4-mercaptotriazole portion is represented by the formula:

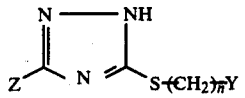

wherein Y is aryl containing 6 to 12 carbon atoms, such as phenyl, p-methoxyphenyl and p-chlorophenyl; n is 0 to 2; and Z is hydrogen, hydroxyl or —$NH_2$; and (iii) an organic, silver halide developing agent, also as described, and (c) a binder, such as a gelatino binder. The optimum concentrations and ratios of components in such a layer or layers will depend upon such factors as the desired image, particular components of the heat developable material, processing conditions and the like. Such a combination of materials can comprise an antifoggant, such as a 3-mercapto-1,2,4-triazole antifoggant and a toning agent, as described. A useful embodiment within this combination is a heat developable photographic element comprising a support having thereon, in reactive association, (a) photosensitive silver halide, especially a gelatino photosensitive silver halide emulsion, (b) an image-forming combination comprising (i) a silver 1-methyl-4-imidazoline-2-thione, with (ii) a silver 3-amino-5-benzylthio-1,2,4-triazole, and (iii) an organic, silver halide developing agent, as described, and (c) a polymeric binder, typically a gelatino binder. Silver salts of certain 1,2,4-mercaptotriazole derivatives in heat developable photographic materials are described in copending U.S. application Ser. No. 778,183 of Knight, deMauriac and Graham, filed Mar. 16, 1977, now U.S. Pat. No. 4,123,274, this description of which is incorporated herein by reference.

A variety of imagewise exposure means is useful with the heat developable materials according to the invention. The heat developable materials are typically sensitive to the ultraviolet and blue regions of the spectrum and exposure means that provide this radiation are preferred. Typically, however, a spectral sensitizing dye is useful in the heat developable materials to provide a sensitivity to a broader range of the spectrum. Exposure means using other ranges of the electromagnetic spectrum are useful when suitable sensitizing dyes are present in the imaging materials. Typically, a photosensitive material according to the invention is exposed imagewise with a visible light source, such as a tungsten lamp, to provide a developable latent image in the imaging material, although other sources of radiation are useful such as lasers, electron beams and the like.

A visible image can be developed in a heat developable material as described within a short time after imagewise exposure merely by uniformly heating the heat developable material to moderately elevated temperatures. For example, the heat developable element can be heated, after imagewise exposure, to a temperature within the range of about 120° C. to about 180° C. Heating is carried out until a desired image is developed and stabilized, typically within about 1 to about 90 seconds, such as within about 1 to about 30 seconds. The heat developable material according to the invention is preferably heated to a temperature within the range of about 150° C. to about 170° C. until a desired image is developed and stabilized, typically for about 1 to about 30 seconds. In especially useful embodiments of the invention, heat developable materials, such as those having a transparent film support, become transparent in the non-exposed areas during the described heating and remain transparent in those areas after heating.

Another embodiment of the invention is a process of developing and stabilizing an image in an exposed, heat developable and stabilizable photographic element, as described, comprising heating the element to a temperature within the range of about 120° C. to about 200° C. until an image is developed and stabilized, such as for about 1 to about 90 seconds. An especially useful process according to the invention is a process of developing and stabilizing an image in an exposed, heat developable photographic element comprising a support having thereon, in reactive association, (a) a gelatino photosensitive silver halide emulsion, (b) an image-forming combination comprising (i) a silver 1-methyl-4-imidazoline-2-thione, with (ii) an organic, silver halide developing agent, as described, and (c) a polymeric binder, typically a gelatino binder, comprising heating the element to a temperature within the range of about 120° C. to about 180° C. for about 1 to about 60 seconds until an image is developed and stabilized.

Although it is often undesirable, due to the lack of control and preparation, a portion of the described photographic silver halide can be prepared in situ in the described material according to the invention. Such a method of preparation of photographic silver halide in situ in a photothermographic material is described, for example, in U.S. Pat. No. 3,457,075 of Morgan et al, issued July 22, 1969.

Processing according to the invention is usually carried out under ambient conditions of pressure and humidity. Pressures and humidity outside normal atmospheric conditions can be useful if desired; however, normal atmospheric conditions are preferred.

A heat developable photographic material according to the invention can be useful for forming a negative or positive image.

A variety of means can be useful to provide the necessary heating of the described heat developable materials to provide a developed and stabilized image. The heating means can be a simple hot plate, iron, roller, ultrasonic heating means or the like.

The following examples are included for a further understanding of the invention. Percentages as described herein are by weight unless otherwise indicated.

EXAMPLE 1

Dispersion

This illustrates preparation of a dispersion of a silver imidazoline-2-thione according to the invention.

1-Methyl-4-imidazoline-2-thione (referred to herein as M-1) (5.7 grams, 0.05 mole) was dissolved in 75 ml of isopropanol and 125 ml of water in a mechanical blender fitted with a 70° F. (21° C.) water jacket. While blending the resulting composition at a low speed, silver nitrate (6.07 grams, 0.0357 mole) in 50 ml of water was added quickly and the blending speed was increased and then continued for 15 minutes until a stable dispersion resulted.

The above dispersion preparation was repeated with the exception that water was used in place of isopropanol. It was found that the isopropanol composition permitted better, longer term keeping properties of the dispersion.

The above dispersion was prepared using a ligand to silver ion molar ratio within the range of 1.0 to 1.6. The dispersion containing the silver salt prepared from silver nitrate contained a ligand to silver ion molar ratio of 1.4.

EXAMPLE 2

Use of 1-methyl-4-imidazoline-2-thione (M-1)

As described in Example 1, the ligand, 1-methyl-4-imidazoline-2-thione, was reacted with silver nitrate to provide a molar ratio of ligand to silver ion of 1.4.

The following composition was mixed and then coated at a wet coating thickness of about 4 mil on a white paper support and at a silver coverage to provide about 10 mg of silver/dm$^2$ of support:

| | | |
|---|---|---|
| dispersion containing M-1 | 5.0 ml | (0.7 mmoles of Ag) |
| 0.5% aqueous solution of surfactant (Surfactant 10G which is a trade name and a polyglycol ether available from Olin Corporation, U.S.A.) | 0.5 ml | |
| silver bromoiodide gelatino emulsion (0.1 millimole of silver, 2.5% iodide) | 0.4 ml | |
| 1.0% by weight aqueous solution of 3-mercapto-1,2,4-triazole | 0.5 ml | |
| 5.0% aqueous gelatin solution | 2.0 ml | |
| 10% aqueous solution of 4-hydroxymethyl-4-methyl-1-Phenyl-3-pyrazolidone | 0.7 ml | |

The resulting composition coated on a white, paper support provided a heat developable photographic element according to the invention. The photographic material was permitted to dry and then was imagewise exposed to white light (a commercial sensitometer was used with an exposure time of 5 seconds) to provide a developable latent image. The exposed photographic element was then overall heated by contacting the element with a heated metal block for 4 seconds at temperatures of 150° C. to about 170° C. A developed image was produced having a maximum reflection density of 1.0 and a minimum reflection density of 0.07.

Exposure of the described, processed element to white light (150 foot candles) for 24 hours resulted in a background density increase of less than 0.03. This indicated the image was developed and stabilized.

Similar results were obtained using other photosensitive silver halide emulsions, including silver iodide, silver chloride and silver bromide gelatino emulsions. Processing temperature latitude provided a maximum density variation of less than 0.1 over the processing temperature range of 150° C. to 170° C. When the processing temperature time was extended to 10 seconds at 160° C., no fog generation or change in maximum density was observed.

The processed element appeared white and glossy in the non-image areas.

When the procedure was repeated with the exception that a transparent film base was employed in place of the paper support, the element appeared transparent in the non-image areas upon processing.

EXAMPLE 3

Sensitizing Dye Added

The procedure described in Example 2 was repeated with the exception that the composition prior to coating contained 2 grams of the cyanine sensitizing dye:

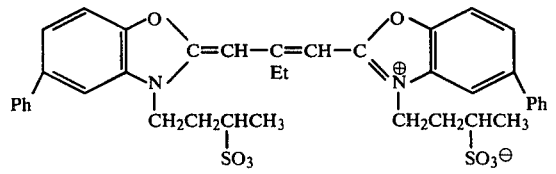

per mole of silver in the element. Ph represents a phenyl group and Et represents ethyl. The resulting element had green sensitivity as a result of the added cyanine sensitizing dye. The dye did not adversely affect the maximum and minimum density results observed in the preceding example.

EXAMPLE 4

Use of a Heat Sensitive Base-Release Agent

A photographic element was prepared similar to that described in Example 2 with the exception that in place of the 10% solution of the pyrazolidone compound a combination of 0.1 ml of the described 10% solution of the pyrazolidone compound and 1.0 ml of a 10% aqueous tertiary-butylhydroquinone solution was used as a combination of developing agents. Although the resulting developed image from such a material was similar to that provided in the preceding Example 2, the post-processing stability was significantly less than that provided in Example 2.

It was found that adding a base-release agent which was guanidinium trichloroacetate provided increased post-processing stability. The following components were mixed to provide a heat developable photographic composition:

| | |
|---|---|
| dispersion containing M-l (0.84 millimoles of silver, ligand to silver ion ratio of 1.4) | 5.0 ml |
| 10% aqueous solution surfactant of Example 1 | 0.2 ml |
| silver iodide gelatino emulsion (0.1 millimole of silver) | 0.4 ml |
| 10% aqueous tertiary butyl-hydroquinone solution | 1.0 ml |
| 10% aqueous solution of 4-hydroxymethyl-4-methyl-phenyl-3-pyrazolidone | 0.1 ml |
| 5% aqueous solution of guanidinium trichloroacetate | 2.0 ml |
| 5% aqueous gelatin solution | 1.0 ml |

After the above components were mixed, the resulting composition was coated on a polyethylene coated paper support at a wet coating thickness of about 4 mils. The photographic coating was permitted to dry and then imagewise exposed to white light as described in Example 2 to provide a developable latent image in the element. The element was then uniformly heated by contacting the element with a heated metal block for 5 seconds at 160° C. to provide a developed image. The developed image had a maximum reflection density of 0.67 and a minimum density of 0.10. The element was then exposed for 24 hours to white light (150 foot candles). No change in background density was observed during this 24-hour exposure period.

EXAMPLE 5

Use of 1-phenyl-5-carboximidazoline-2-thione

The procedure described in Example 2 was repeated with the exception that 1-phenyl-5-carboximidazoline-2-thione was used in place of the described M-1. The ligand to silver ion ratio used was within the range of 1.2 to 1.5. It was found that in general appearance, image discrimination and stabilization that a satisfactory developed and stabilized image was provided. However, the appearance and discrimination, as well as stabilization, were not as satisfactory as that provided by the composition described in Example 2.

EXAMPLE 6

Use of 1-phenyl-imidazoline-2-thione

The procedure described in Example 2 was repeated with the exception that 1-phenyl-4-imidazoline-2-thione was used in place of M-1 in the described photographic material of Example 2. The ligand to silver ion ratio was within the range of 1.2 to 1.5. Using the exposure and processing steps of Example 2, it was found that this composition provided a developed and stabilized image.

It was found that in the heat developable photographic materials described in the above examples that the most useful developing agents were those developing agents having reducing activity in the described compositions comparable in level to hydroquinone, ascorbic acid, 1-phenyl-3-pyrazolidone and paraphenylenediamine silver halide developing agents. The developing agents are most useful at levels of at least a few milligrams up to several hundred milligrams per 929 square centimeters of support. At very high levels of developing agent it is often difficult to coat the composition and the developing agent can provide undesirable levels of fog. Selection of an optimum developing agent or developing agent combination will depend upon the described factors, such as the particular ligand and the desired image.

It is found that the melt formed by the photographic composition during processing in the above examples directly affects stabilization of the silver halide. The melt also affects development and transparency of the photographic layer on a transparent film support. In some cases the combination of the described developing agent and silver salt melts at the desired temperature and in others it can be desirable to add a separate melt former as described. In some cases the absence of a separate melt-forming compound can adversely affect stabilization upon processing.

In the above examples, it was observed that in most cases a ligand to silver ion ratio which was less than 1.0 could be useful if only image development was desired. However, when both development and post-processing stabilization were desired, it as observed that best results were obtained when the ligand to silver ion ratio was greater than 1.0.

EXAMPLES 7–18

Each of the ligands listed in the following Table I were mixed with silver nitrate or silver trifluoroacetate to prepare a dispersion containing an organic silver salt or complex having a ligand to silver ion ratio within the range of 0.9 to 1.5. The specific conditions were varied according to the particular ligand. A typical dispersion started with a solution (or suspension, if needed) of the ligand in water or in an alcohol-water mixture to which an aqueous solution of silver nitrate or silver trifluoroacetate was added while blending in a commercial, mechanical blender. The blender was fitted with a stainless steel, water containing jacket to maintain the dispersion at the desired temperature during preparation. The resulting dispersion was generally prepared in the absence of a binder, such as gelatin, to help avoid any adverse effect on the formation of the dispersion. The resulting dispersion was mixed in each case with photosensitive silver halide, a small concentration of gelatin or poly(vinyl alcohol) binder, and a silver halide developing agent to provide a photosensitive composition. The resulting photosensitive composition was coated on a suitable paper or film support at about 90 mg. of silver per square foot (corresponding to 9.7 mg. per square decimeter). The coating had a wet coating thickness in each case of about 4 mils. The ratio of silver from the described dispersion to silver from the silver halide was about 7:1. In some cases 3-mercapto-1,2,4-triazole was also added as an antifoggant. The resulting photosensitive element was permitted to dry and then was imagewise exposed to light in a commercial sensitometer to provide a developable latent image in the element. The image was then developed and, in the noted cases in Table I, stabilized by uniformly heating the element by contacting it with a heated metal block at a temperature within the range of 140° C. to 180° C. for a few seconds. Post processing print-up stability was tested following heating of the element by exposing the element to 150 foot candles of fluorescent light for about 16 to about 24 hours at 30° C. The results using this procedure of Examples 7-18 are given in following Table I.

It was observed that the properties and quality of the dispersion containing the ligand and the melt formation upon processing were very important to the resulting developed image. In some cases the silver halide in some of the comparative examples in Table I was attacked by the ligand during melt formation or the silver in photosensitive composition prior to coating on the support was spontaneously reduced on addition of the silver halide developing agent. In each of the comparative examples the result was undesirable. In many instances, such as when preparing the dispersion with M-1, it was more desirable to prepare the dispersion with silver nitrate than with silver trifluoroacetate. The reasons for the more desirable results with silver nitrate were not fully understood.

Table I

| Example No. | Ligand | Ligand to Silver Ion Ratio | Result |
|---|---|---|---|
| 7 | 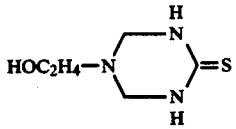 (comparative example) | 1.4<br>2.0 | Reduced on addition of developing agent.<br>Dissolved silver halide. |
| 8 | 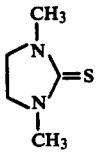 (comparative example) | 1.5<br>2.0 | Reduced on addition of developing agent.<br>Reduced on addition of developing agent. |
| 9 | 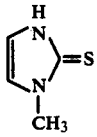 | 4.0<br>1.4 | Precipitate formed on addition of silver halide.<br>Prepared with silver trifluoroacetate. No image initially, but silver ligand slowly crystallized and image was formed. Good post processing stabilization was observed with either silver iodide or silver bromoiodide as the silver halide. Melt formation was good with ascorbic acid or 3-pyrazolidone developers. |
| 10 | 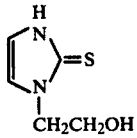 | 1.2<br>1.4 | Weak image was obtained.<br>Good post processing stabilization was observed. |
| 11 | 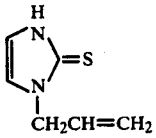 | 1.2<br>1.4 | Weak image was obtained.<br>Difficulty was encountered in coating the composition. |
| 12 | 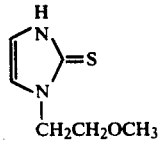 | 1.2<br>1.4 | Weak image was obtained.<br>Reasonable post processing stabilization was observed. |

Table I-continued

| Example No. | Ligand | Ligand to Silver Ion Ratio | Result |
|---|---|---|---|
| 13 | 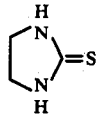 (comparative example) | 1.4 | Brown image was obtained with AgI emulsion. Some post processing stabilization was obtained, but relatively poor melt formation was observed. The melt formation may be improved by addition of citric acid. After 15 hours post processing print-up test at 150 foot candles exposure, a change in minimum density of 0.05 was observed. |
| 14 | 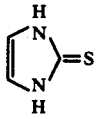 (comparative example) | 1.4 | The dispersion prepared with silver trifluoroacetate was better than that prepared with silver nitrate. The photothermographic composition had better properties with silver iodide as the silver halide and with the addition of citric acid and ascorbic acid. Good post processing stabilization was observed. When the silver halide was silver bromoiodide the composition has less post processing stability. When pyrogallol was added to the composition, the photothermographic composition had better melt-forming properties. |
| 15 | 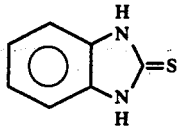 (comparative example) | 1.4 | A mostly aqueous formulation formed with silver trifluoroacetate was poor. No satisfactory melting or post processing stabilization was observed. Addition of a melt former was not observed to improve the composition. |
| 16 | 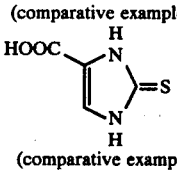 (comparative example) | 1.2 | Almost no image was obtained with a 3-pyrazolidone developing agent. Addition of citric acid or dimethylurea as melt formers did not improve the results. |
| 17 | 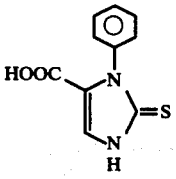 | 1.2 | With silver iodide as the silver halide and a 1-phenyl-3-pyrazolidone as a developing agent a good image was obtained. The developed image has a $D_{max}$ of 1.26 and $D_{min}$ of 0.07. Some post processing stabilization was observed, but it was not as complete as desired for optimum purposes. |
| 18 | 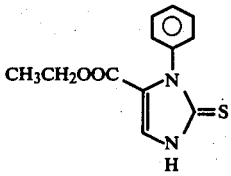 | 1.2 | With a 1-phenyl-3-pyrazolidone devoloping agent and the addition of 3-mercapto-1,2,4-triazole as an antifoggant, a good developed image was obtained with silver bromide and silver iodide emulsions. The developed image was stable to light with silver iodide as the silver halide but did not have the desired post processing stability with silver bromide as the silver halide. |
| | | 1.4 | A good developed image was observed with silver bromide as the silver halide and the developed image had better post processing stability than observed with the composition that had a ligand to silver ion ratio of 1.2. |

The best results were obtained with 1-methyl-4-imidazoline-2-thione (M-1) because, among other properties, the silver salt of this compound provided a developed image and provided post-processing stabilization with a variety of silver halides and melt formation was improved with selection of an appropriate developing agent. Better results were obtained with ascorbic acid and 3-pyrazolidone developing agents than with hydroquinone developing agents also. Hydroquinone developing agents provided better results when they were used with low levels of a 3-pyrazolidone developing agent. In each instance balancing of the components in the heat developable photographic composition is important to provide optimum results.

As a comparative example, the silver salt of 1-(3',5'-dicarboxyphenyl)tetrazoline-5-thione was also tested at a ligand to silver ion ratio of 1.2. The photographic material was similar to that described for Example 7. Relatively weak developed images were obtained with a fine grain silver bromoiodide emulsion and a 3-pyrazolidone developing agent. Melt formation was poor and the developed image was not stable following processing.

Another silver salt that was tested in a photographic composition similar to that of Example 7 was the silver salt of 3-isopropoxy-4-methyl-1H-1,2,4-triazoline-5-thione. This silver salt, when used in place of the described silver salt of Example 7, provided a satisfactory developed and stabilized image.

The invention has been described in detail with particular reference to preferred embodiments thereof, but it will be understood that variations and modifications can be effected within the spirit and scope of the invention.

What is claimed is:

1. In a heat developable photographic element comprising a support having thereon, in reactive association, (a) photosensitive silver halide, with (b) an image-forming combination comprising (i) a silver imidazoline-2-thione, with (ii) an organic, silver halide developing agent and (c) a binder, the improvement wherein said imidazoline-2-thione portion of the silver imidazoline-2-thione is a 1-methyl, 1-ethyl or 1-phenyl-4-imidazoline-2-thione ligand wherein the ratio of said imidazoline-2-thione portion ligand to silver ion in said silver imidazoline-2-thione is at least about 1.0, and, wherein said (a), (b) and (c) form a reaction melt at a temperature within the range of about 120° C. to about 200° C.

2. A photographic element as in claim 1 wherein said photosensitive silver halide is a gelatino photosensitive silver halide emulsion.

3. A photographic element as in claim 1 wherein the ratio of said ligand to silver ion in said silver imidazoline-2-thione is within the range of about 1.2 to about 1.5.

4. A heat developable photographic element comprising a support having thereon, in reactive association, (a) a gelatino photosensitive silver halide emulsion, (b) an image-forming combination comprising (i) a silver 1-methyl-4-imidazoline-2-thione and (ii) an organic, silver halide developing agent, and (c) a polymeric binder, and wherein the molar ratio of the imidazoline-2-thione portion to silver ion in the silver 1-methyl-4-imidazoline-2-thione is at least 1.0.

5. A photographic element as in claim 4 wherein said developing agent is a 3-pyrazolidone silver halide developing agent.

6. A photographic element as in claim 4 wherein said binder is a gelatino binder.

7. A photographic element as in claim 4 also comprising a 3-mercapto-1,2,4-triazole antifoggant.

8. A photographic element as in claim 4 wherein the molar ratio of the imidazoline-2-thione portion to silver ion in the silver 1-methyl-4-imidazoline-2-thione is within the range of about 1.2 to about 1.5.

9. The photographic element as in claim 4 wherein said developing agent is a combination of 4-hydroxymethyl-4-methyl-1-phenyl-3-pyrazolidone with t-butylhydroquinone or isopropylhydroquinone.

10. The photographic element as in claim 4 wherein the concentration of said developing agent is within the range of about 0.25 to about 1.0 millimole of developing agent per millimole of silver ion in the element.

11. A photographic element as in claim 4 wherein said (a), (b) and (c) form a reaction melt at a temperature within the range of about 120° C. to about 200° C.

12. A heat developable photographic element comprising a support having thereon, in reactive association, (a) a gelatino photosensitive silver halide emulsion, (b) an image-forming combination comprising (i) a silver imidazoline-2-thione wherein the imidazoline-2-thione portion is represented by the formula:

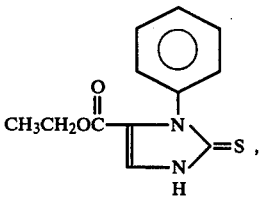

and the molar ratio of the imidazoline-2-thione portion to silver ion in the silver imidazoline-2-thione is within the range of about 1.2 to about 1.6, with (ii) an organic silver halide developing agent selected from the group consisting of 3-pyrazolidone developing agents and ascorbic acid developing agents, and (c) a gelatino binder, and wherein said (a), (b) and (c) form a reaction melt at a temperature within the range of about 120° C. to about 200° C.

13. A heat developable photographic element comprising a support having thereon, in reactive association, (a) a gelatino photosensitive silver halide emulsion, (b) an image-forming combination comprising (i) a silver imidazoline-2-thione having a molar ratio of the imidazoline-2-thione portion to silver ion in the silver 1-hydroxyethyl-4-imidazoline-2-thione within the range of about 1.2 to about 1.5, and (ii) an organic silver halide developing agent selected from the group consisting of 3-pyrazolidone developing agents and ascorbic acid developing agents, and (c) a gelatino binder, and wherein said (a), (b) and (c) form a reaction melt at a temperature within the range of about 120° C. to about 200° C.

14. A heat developable photographic element comprising a support having thereon, in reactive association, (a) a gelatino, photosensitive silver halide emulsion, (b) an image-forming combination comprising (i) a silver 1-methyl-4-imidazoline-2-thione having a molar ratio of the imidazoline-2-thione portion to silver ion in the silver imidazoline-2-thione within the range of about 1.2 to about 1.5, with (ii) a combination of silver halide developing agents consisting essentially of 4-hydroxymethyl-4-methyl-1-phenyl-3-pyrazolidone with t-butylhydroquinone or with isopropylhydroquinone, and (c) a gelatino binder, and wherein said (a), (b) and (c) form a reaction melt at a temperature within the range of about 120° C. to about 200° C.

15. In a heat developable photographic composition comprising (a) photosensitive silver halide, with (b) an image-forming combination comprising (i) a silver imidazoline-2-thione, with (ii) an organic, silver halide developing agent, and (c) a binder, the improvement wherein said imidazoline-2-thione portion of the silver imidazoline-2-thione is a 1-methyl, 1-ethyl or 1-phenyl-4-imidazoline-2-thione ligand wherein the ratio of said ligand to silver ion is at least 1.0; and, wherein said (a), (b) and (c) form a reaction melt at a temperature within the range of about 120° C. to about 200° C.

16. A photographic composition as in claim 15 wherein said photosensitive silver halide is a gelatino photosensitive silver halide emulsion.

17. A photographic composition as in claim 15 wherein the molar ratio of said ligand to silver ion in said silver imidazoline-2-thione is within the range of about 1.2 to about 1.5.

18. A heat developable photographic composition comprising (a) a gelatino photosensitive silver halide emulsion, (b) an image-forming combination comprising (i) a silver 1-methyl-4-imidazoline-2-thione, with (ii) an organic, silver halide developing agent, and (c) a polymeric binder, and wherein the molar ratio of the imidazoline-2-thione portion to silver ion in the silver 1-methyl-4-imidazoline-2-thione is at least 1.0.

19. A photographic composition as in claim 18 wherein said developing agent is a 3-pyrazolidone silver halide developing agent.

20. A photographic composition as in claim 18 wherein said binder is a gelatino binder.

21. A photographic composition as in claim 18 also comprising a 3-mercapto-1,2,4-triazole antifoggant and toning agent.

22. A photographic composition as in claim 18 wherein the molar ratio of the 1-methyl-4-imidazoline-2-thione portion to silver ion in said silver 1-methyl-4-imidazoline-2-thione is within the range of 1.2 to 1.5.

23. A photographic composition as in claim 18 wherein said developing agent is a combination of 4-hydroxymethyl-4-methyl-1-phenyl-3-pyrazolidone with t-butylhydroquinone or isopropylhydroquinone.

24. A photographic composition as in claim 18 wherein the concentration of said developing agent is within the range of about 0.25 to about 1.0 millimole of developing agent per millimole of silver ion.

25. A photographic composition as in claim 18 wherein said (a), (b) and (c) form a reaction melt at a temperature within the range of about 120° C. to about 200° C.

26. A heat developable photographic composition comprising (a) a gelatino photosensitive silver halide emulsion, (b) an image-forming combination comprising (i) a silver imidazoline-2-thione, wherein the imidazoline-2-thione portion is represented by the formula:

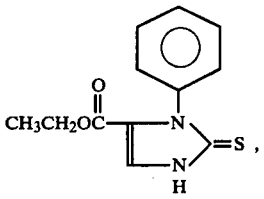

and the molar ratio of the imidazoline-2-thione portion to silver ion in the silver imidazoline-2-thione is within the range of about 1.2 to about 1.6, with (ii) an organic, silver halide developing agent selected from the group consisting of 3-pyrazolidone developing agents and ascorbic acid developing agents, and (c) a gelatino binder, and wherein said (a), (b) and (c) form a reaction melt at a temperature within the range of about 120° C. to about 200° C.

27. A heat developable photographic composition comprising (a) a gelatino photosensitive silver halide emulsion, (b) an image-forming combination comprising (i) a silver 1-hydroxyethyl-4-imidazoline-2-thione having a molar ratio of the imidazoline-2-thione portion to silver ion in the silver 1-hydroxyethyl-4-imidazoline-2-thione within the range of about 1.2 to about 1.5, and (ii) an organic, silver halide developing agent selected from the group consisting of 3-pyrazolidone developing agents and ascorbic acid developing agents, and (c) a gelatino binder, and wherein said (a), (b) and (c) form a reaction melt at a temperature within the range of about 120° C. to about 200° C.

28. A heat developable photographic composition comprising (a) a gelatino, photosensitive silver halide emulsion, (b) an image-forming combination comprising (i) a silver 1-methyl-4-imidazoline-2-thione having a molar ratio of the imidazoline-2-thione portion to silver ion in the silver 1-methyl-4-imidazoline-2-thione within the range of 1.2 to 1.5, with (ii) a combination of silver halide developing agents consisting essentially of 4-hydroxymethyl-4-methyl-1-phenyl-3-pyrazolidone with t-butylhydroquinone or isopropylhydroquinone, and (c) a gelatino binder.

29. A process of developing an image in a heat developable photographic element as defined in claim 1 comprising heating said element to a temperature within the range of 120° C. to 200° C. until an image is developed.

30. A process of developing an image in a heat developable photographic element as defined in claim 4 comprising heating said element to a temperature within the range of 120° C. to 200° C. until an image is developed.

31. A process of developing an image in a heat developable photographic element as defined in claim 4 comprising heating said element to a temperature within the range of 120° C. to 200° C. for about 1 to about 60 seconds until an image is developed.

32. A heat developable photographic element comprising a support having thereon, in reactive association, (a) photosensitive silver halide, (b) an image-forming combination comprising (i) a silver 4-imidazoline-2-thione, with (ii) a silver 1,2,4-mercaptotriazole, wherein the 1,2,4-mercaptotriazole portion is represented by the formula:

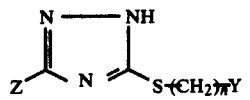

wherein Y is aryl containing 6 to 12 carbon atoms; n is 0 to 2; and Z is hydrogen, hydroxyl or $-NH_2$; and (iii) an organic, silver halide developing agent, and (c) a binder.

33. A heat developable photographic element as in claim 32 wherein said (a), (b) and (c) form a reaction melt at a temperature within the range of about 120° C. to about 200° C.

34. A photographic element as in claim 32 wherein Y is phenyl, p-methoxyphenyl or p-chlorophenyl.

35. A photographic element as in claim 32 wherein said photosensitive silver halide is a gelatino photosensitive silver halide emulsion.

36. A photographic element as in claim 32 also comprising a 3-mercapto-1,2,4-triazole antifoggant.

37. A heat developable photographic element comprising a support having thereon, in reactive association, (a) photosensitive silver halide, (b) an image-forming combination comprising (i) a silver 1-methyl-4-imidazoline-2-thione, with (ii) a silver 3-amino-5-benzylthio-1,2,4-triazole, and (iii) an organic, silver halide developing agent, and (c) a polymeric binder.

38. A heat developable photographic element comprising a support having thereon, in reactive association, (a) a gelatino, silver bromoiodide photosensitive emulsion, (b) an image-forming combination comprising (i) a silver 1-methyl-4-imidazoline-2-thione, with (ii) a silver 3-amino-5-benzylthio-1,2,4-triazole, and (iii) an organic, silver halide developing agent comprising a 3-pyrazolidone silver halide developing agent, and (c) a gelatino binder.

39. A heat developable photographic composition comprising (a) photosensitive silver halide, (b) an image-forming combination comprising (i) a silver 4-imidazoline-2-thione, with (ii) a silver 1,2,4-mercaptotriazole wherein the 1,2,4-mercaptotriazole portion is represented by the formula:

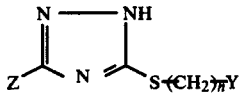

wherein Y is aryl containing 6 to 12 carbon atoms; n is 0 to 2; and Z is hydrogen, hydroxyl or $-NH_2$; and (iii) an organic, silver halide developing agent, and (c) a binder.

40. A photographic composition as in claim 39 wherein said (a), (b) and (c) form a reaction melt at a temperature within the range of about 120° C. to about 200° C.

41. A photographic composition as in claim 39 wherein Y is phenyl, p-methoxyphenyl or p-chlorophenyl.

42. A photographic composition as in claim 39 wherein said photosensitive silver halide is a gelatino photosensitive silver halide emulsion.

43. A photographic composition as in claim 39 also comprising a 3-mercapto-1,2,4-triazole antifoggant.

44. A heat developable photographic composition comprising (a) photosensitive silver halide, (b) an image-forming combination comprising (i) a silver 1-methyl-4-imidazoline-2-thione, with (ii) a silver 3-amino-5-benzylthio-1,2,4-triazole, and (iii) an organic, silver halide developing agent, and (c) a polymeric binder.

45. A heat developable photographic composition comprising (a) a gelatino, silver bromoiodide photosensitive emulsion, (b) an image-forming combination comprising (i) a silver 1-methyl-4-imidazoline-2-thione with (ii) a silver 3-amino-5-benzylthio-1,2,4-triazole, and (iii) an organic, silver halide developing agent comprising a 3-pyrazolidone silver halide developing agent, and (c) a gelatino binder.

46. A process of developing an image in a heat developable photographic element as defined in claim 32 comprising heating said element to a temperature within the range of 120° C. to 200° C. until an image is developed.

47. A process of developing an image in a heat developable photographic element as defined in claim 37 comprising heating said element to a temperature within the range of 120° C. to 200° C. until an image is developed.

* * * * *